US011705682B2

(12) United States Patent
Lin et al.

(10) Patent No.: US 11,705,682 B2
(45) Date of Patent: Jul. 18, 2023

(54) MULTI-POSITION CONVERSION DEVICE AND A CONVERSION SOCKET WITH THE MULTI-POSITION CONVERSION DEVICE

(71) Applicant: Dongguan Wontravel Electric Co., Ltd., Guangdong (CN)

(72) Inventors: Liang Guan Lin, Guangdong (CN); Xiao Long Li, Guangdong (CN); Lei Hu, Guangdong (CN)

( * ) Notice: Subject to any disclaimer, the term of this patent is extended or adjusted under 35 U.S.C. 154(b) by 186 days.

(21) Appl. No.: 17/103,875

(22) Filed: Nov. 24, 2020

(65) Prior Publication Data

US 2022/0013967 A1 Jan. 13, 2022

(30) Foreign Application Priority Data

Jul. 13, 2020 (CN) ..... 202021373450.2

(51) Int. Cl.

| | |
|---|---|
| ***H01R 13/514*** | (2006.01) |
| ***H01R 25/00*** | (2006.01) |
| ***H01R 43/18*** | (2006.01) |
| *H01R 105/00* | (2006.01) |

(52) U.S. Cl.

CPC ..... *H01R 25/006* (2013.01); *H01R 13/514* (2013.01); *H01R 43/18* (2013.01); *H01R 2105/00* (2013.01)

(58) Field of Classification Search

CPC .... H01R 25/006; H01R 13/514; H01R 43/18; H01R 2105/00; H01R 24/76; H01R 24/78

See application file for complete search history.

(56) References Cited

U.S. PATENT DOCUMENTS

| | | | | |
|---|---|---|---|---|
| 5,094,630 A * | 3/1992 | Jammet | H01R 31/02 439/652 |
| 5,383,799 A * | 1/1995 | Fladung | H01R 25/006 439/652 |
| 6,929,514 B1 * | 8/2005 | Chuang | H01R 43/16 439/652 |
| 7,892,036 B2 * | 2/2011 | Lee | H01R 31/02 439/638 |
| 10,468,840 B2 * | 11/2019 | Schaub | F21V 23/06 |

* cited by examiner

*Primary Examiner* — Tho D Ta

(74) *Attorney, Agent, or Firm* — Prakash Nama; Global IP Services, PLLC

(57) ABSTRACT

A multi-position conversion device and a conversion socket with the multi-position conversion device; the first pin, the second pin, the first connecting sheet and the second connecting sheet are installed together onto the main frame to modularize and integrate the conversion device; therefore, only one main frame is needed to complete the installation of the first pin, the second pin, the first connecting sheet and the second connecting sheet, and this can effectively decrease the volume of the multi-position conversion device and thus decrease the volume and weight of the whole conversion socket, prevent the conversion socket from sagging due to gravity and thus increase the corresponding user experience and safety; meanwhile, after being modularized, the multi-position conversion device is installed directly into the housing and thus can decrease the assembling steps, reduce the assembling difficulty and finally improve the assembling efficiency.

13 Claims, 8 Drawing Sheets

MULTI-POSITION CONVERSION DEVICE AND A CONVERSION SOCKET WITH THE MULTI-POSITION CONVERSION DEVICE

BACKGROUND OF THE INVENTION

The present utility model relates to the technical field of conversion sockets, in particular relates to a multi-position conversion device and a conversion socket with the multi-position conversion device.

To enable the conversion sockets to be inserted simultaneously with the plugs of a plurality of electronic products and occupy less space, the existing multi-position conversion sockets are designed with insertion positions on a plurality of sides of the housings of such multi-position conversion sockets (such as the top, left and right sides of housings) to arrange the pins of plugs respectively.

An existing multi-position conversion sockets generally comprises a housing and a multi-position conversion device, wherein the bottom side of the housing is designed with pin apertures, at least two of the top, left, right, front and rear sides of the housing are designed with jack panels, each jack panel is designed with jack groups (each jack group consists of two or three jacks), the multi-position conversion device comprises a pin subassembly and a connecting subassembly, the pin subassembly comprises a pin support and two or three pins with the upper parts installed onto the pin support (when there are two pins, the two pins are used to connect the live wire and the null wire of the power socket respectively; when there are three pins, the three pins are used to connect the live wire, the null wire and the earth wire of the power socket respectively), the lower parts of the pins extend out the housing via the pin apertures; the connecting subassembly comprises a connecting sheet support and two or three connecting sheets which are installed into corresponding slots of the connecting sheet support and of electrical connection with corresponding pins respectively via the conducting pieces, and when being used, the pins of the plugs of electronic products are inserted into corresponding slots of the connecting sheet support and connected with corresponding connecting sheets to connect the circuit.

An existing multi-position conversion socket can accommodate a plurality of plugs while not excessively occupying space, but has some disadvantages that: 1. Its pins and connecting sheets are completely separate, so it is necessary to set the pin supports and connecting sheet supports respectively for independent installation and then conduct electrical connection via conducting pieces and finally install the pins and connecting sheets into the housing, on the one hand, such method requires the housing to have sufficient space for accommodating the pin supports and the connecting sheet supports simultaneously and thus causes the relatively big volume and weight of the multi-position conversion socket and thus easily causes the sagging of the conversion socket due to gravity and the corresponding poor user experience and certain safety risk; on the other hand, after the pins and the connecting sheets are installed onto the pin supports and the connecting sheet supports respectively, installation of the pins and the connecting sheets into the housing increases the assembling steps and difficulty and thus decreases the assembling efficiency. 2. The arrangement of existing multi-position conversion sockets is not reasonable (mainly due to relatively excessive misalignment of pins with the pin apertures on the top side) and it is impossible to increase the number of multi-position conversion sockets at the time of use. 3. When being inserted into a wall-type power socket, an existing multi-position conversion socket does not completely fit the wall-type power socket due to size or shape and the direction arrangement of the earth-wire jacks is different, so the overall aesthetic degree is affected.

BRIEF SUMMARY OF THE INVENTION

The main purpose of the present utility model is to provide a multi-position conversion device and a conversion socket with the multi-position conversion device, aiming to reduce the volume of the multi-position conversion socket and improve the assembling efficiency.

To achieve the purpose described above, the present utility model provides a multi-position conversion device, comprising a main frame, a first pin, a second pin, a first connecting sheet and a second connecting sheet, wherein the upper parts of the first pin and the second pin are installed onto the main frame, at least two of the upper, left, right, front and rear sides of the main frame are designed with a first inserting slot and a second inserting slot respectively, the first connecting sheet and the second connecting sheet are inserted into the main frame and of electrical connection with the first pin and the second pin respectively, the first connecting sheet has a first connecting part extending to the first inserting slot and the second connecting sheet has a second connecting part extending to the second inserting slot.

The present utility model also provides a conversion socket, comprising a housing and a multi-position conversion device described above.

A technical solution of the present utility model installs the first pin, the second pin, the first connecting sheet and the second connecting sheet together onto the main frame to modularize and integrate the conversion device; compared with the prior art which installs the first pin, the second pin, the first connecting sheet and the second connecting sheet respectively onto different supports, the present utility model only needs one main frame to complete the installation of the first pin, the second pin, the first connecting sheet and the second connecting sheet, this can effectively decrease the volume of the multi-position conversion device and thus decrease the volume and weight of the whole conversion socket, prevent the conversion socket from sagging due to gravity and thus increase the corresponding user experience and safety; meanwhile, after being modularized, the multi-position conversion device is installed directly into the housing and thus can decrease the assembling steps, reduce the assembling difficulty and finally improve the assembling efficiency.

DETAILED DESCRIPTION OF THE INVENTION

Figure 1:
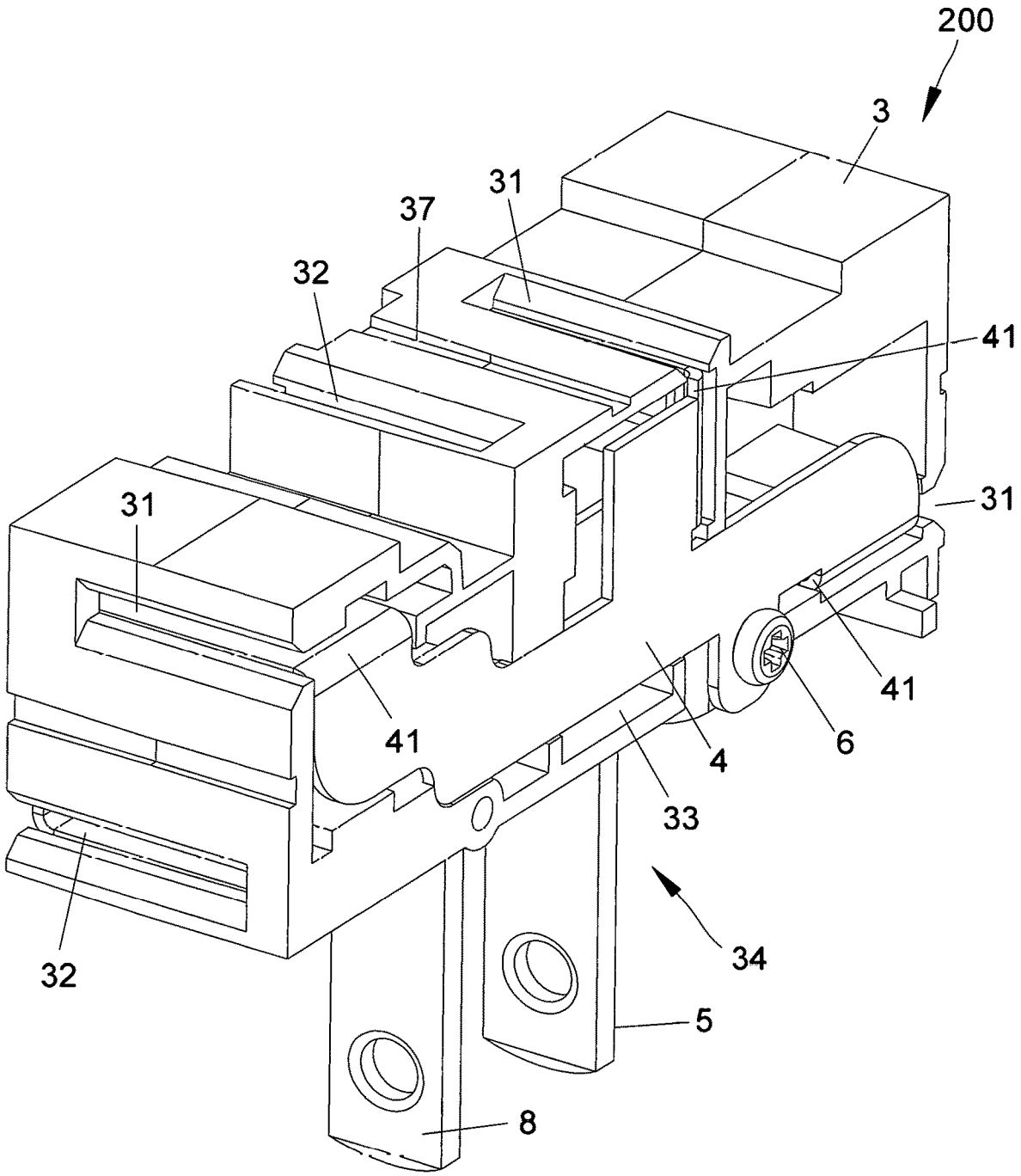
FIG. 1 is a schematic three-dimensional view of a two-pole multi-position conversion device of the present utility model.

The technical solutions of the present utility model will be described more clearly and fully in conjunction with the accompanying drawings of the present utility model, and obviously, the described embodiments are merely a part of the embodiments of the present utility model, not all the embodiments. Based on the embodiments of the present utility model, all the other embodiments obtained by the ordinary skilled in the art without creative labors belong to the scope claimed by the present utility model.

It should be noted that if an embodiment of the present utility model relates to directive instructions (such as upper, lower, left, right, front, rear, top, bottom, inside, outside, vertical, transverse, longitudinal, counter-clockwise, clockwise, circumferential, radial and axial), these directive instructions are merely used to explain the relative position relationship, the movement and so on among the components at certain specific posture (as shown in the accompanying drawings); if the specific posture changes, the directive instructions should be changed accordingly.

In addition, if an embodiment of the present utility model relates to the descriptions such as "first" and "second", these descriptions are merely used for description and should not be understood to indicate or imply their relative importance or implicitly indicate the number of the corresponding technical features. This shows that the features limited with "first" and "second" can explicitly or implicitly include one such feature at least. Moreover, the technical solutions among the embodiments can be in combination with each other; however, such combination must be on the premise that those skilled in the art can realize the related technical solutions; when the technical solutions are inconsistent or cannot be realized, such combination of technical solutions should be deemed to be inexistent and not in the scope claimed by the present utility model.

The present utility model provides a multi-position conversion device.

In the embodiments of the present utility model, as shown in FIG. 1 to FIG. 8, the multi-position conversion device 200 can be installed in the housing 100 of the conversion socket, comprising the main frame 3, the first pin 5, the second pin 8, the first connecting sheet 4 and the second connecting sheet 7, the upper parts of the first pin 5 and the second pin 8 are installed onto the main frame 3, the lower parts can extend out via the pin apertures 2*a* on the bottom side of the housing 100 so that it can be inserted into the power socket (not shown in the drawings) at the time of use, of electrical connection with the live and null wires of the power socket; at least two of the top, left, right, front and rear sides of the main frame 3 are designed with a first inserting slot 31 and a second inserting slot 32 respectively, the first connecting sheet 4 and the second connecting sheet 7 are inserted into the main frame 3 and of electrical connection with the first pin 5 and the second pin 8 respectively (concretely meaning the electrical connection of the first connecting sheet 4 with the first pin 5 and the electrical connection of the second connecting sheet 7 with the second pin 8), the first connecting sheet 4 has a first connecting part 41 extending to the first inserting slot 31 and the second connecting sheet 7 has a second connecting part 71 extending to the second inserting slot 32, the housing 100 is designed with corresponding pin apertures 1*a* on the opposite sides of the first inserting slot 31 and the second inserting slot 32 for the first pin and the second pin (not shown in the drawings) of the plug of an electronic product to pass through the corresponding first inserting slot 31 and second inserting slot 32, the first pin is inserted into the first inserting slot 31 and then propped against the first connecting part 41 for electrical connection, the second pin is inserted into the second inserting slot 32 and then propped against the second connecting part 71 for electrical connection. Compared with the prior art which installs the first pin 5, the second pin 8, the first connecting sheet 4 and the second connecting sheet 7 respectively onto different supports, the present utility model only needs one main frame 3 to complete the installation of the first pin 5, the second pin 8, the first connecting sheet 4 and the second connecting sheet 7, this can effectively decrease the volume of the multi-position conversion device 200 and thus decrease the volume and weight of the whole conversion socket, prevent the conversion socket from sagging due to gravity and thus increase the corresponding user experience and safety; meanwhile, after being modularized, the multi-position conversion device 200 is installed directly into the housing 100 and thus can decrease the assembling steps, reduce the assembling difficulty and finally improve the assembling efficiency.

It should be noted that the parts such as top and bottom sides of the main frame 3 are defined on the premise that the first pin and the second pin are inserted downward into the power socket (not shown in the drawings), wherein the side of the main frame 3 adjacent to the power socket is the bottom side and the side away from the power socket is the top side.

Figure 2:
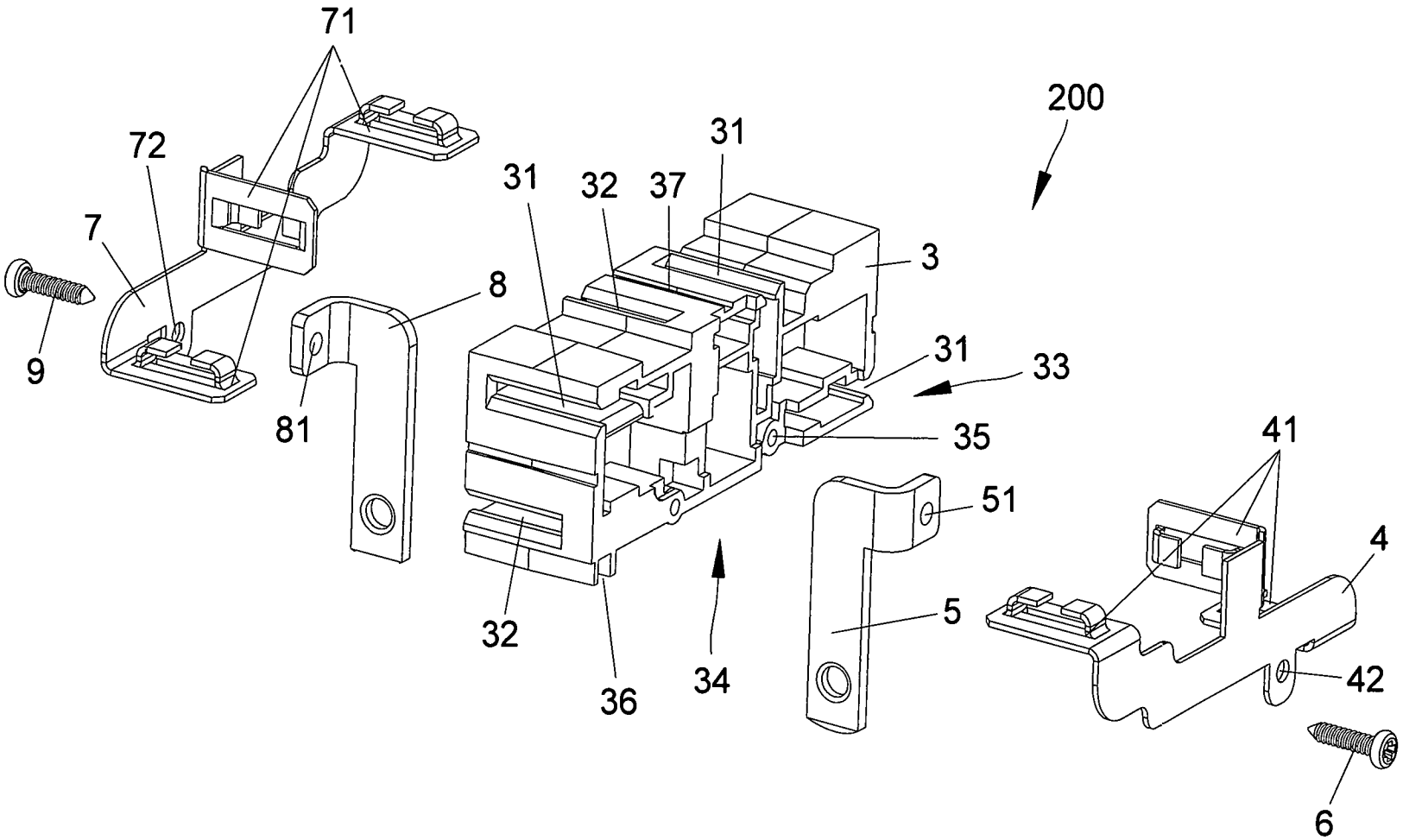
FIG. 2 is a schematic exploded view of a two-pole multi-position conversion device of the present utility model.
Figure 3:
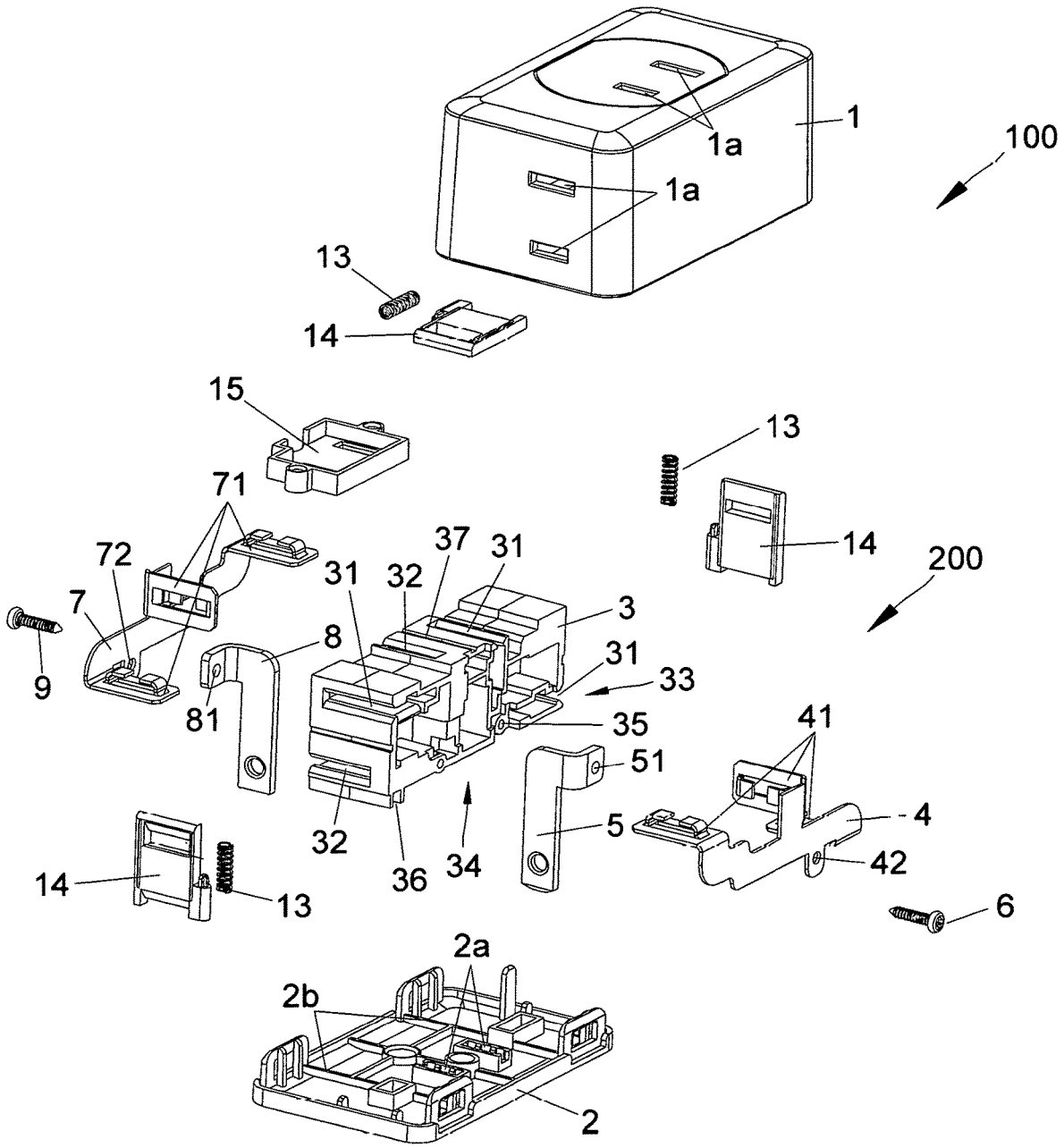
FIG. 3 is a schematic exploded view of a two-pole multi-position conversion socket of the present utility model.
Figure 4:
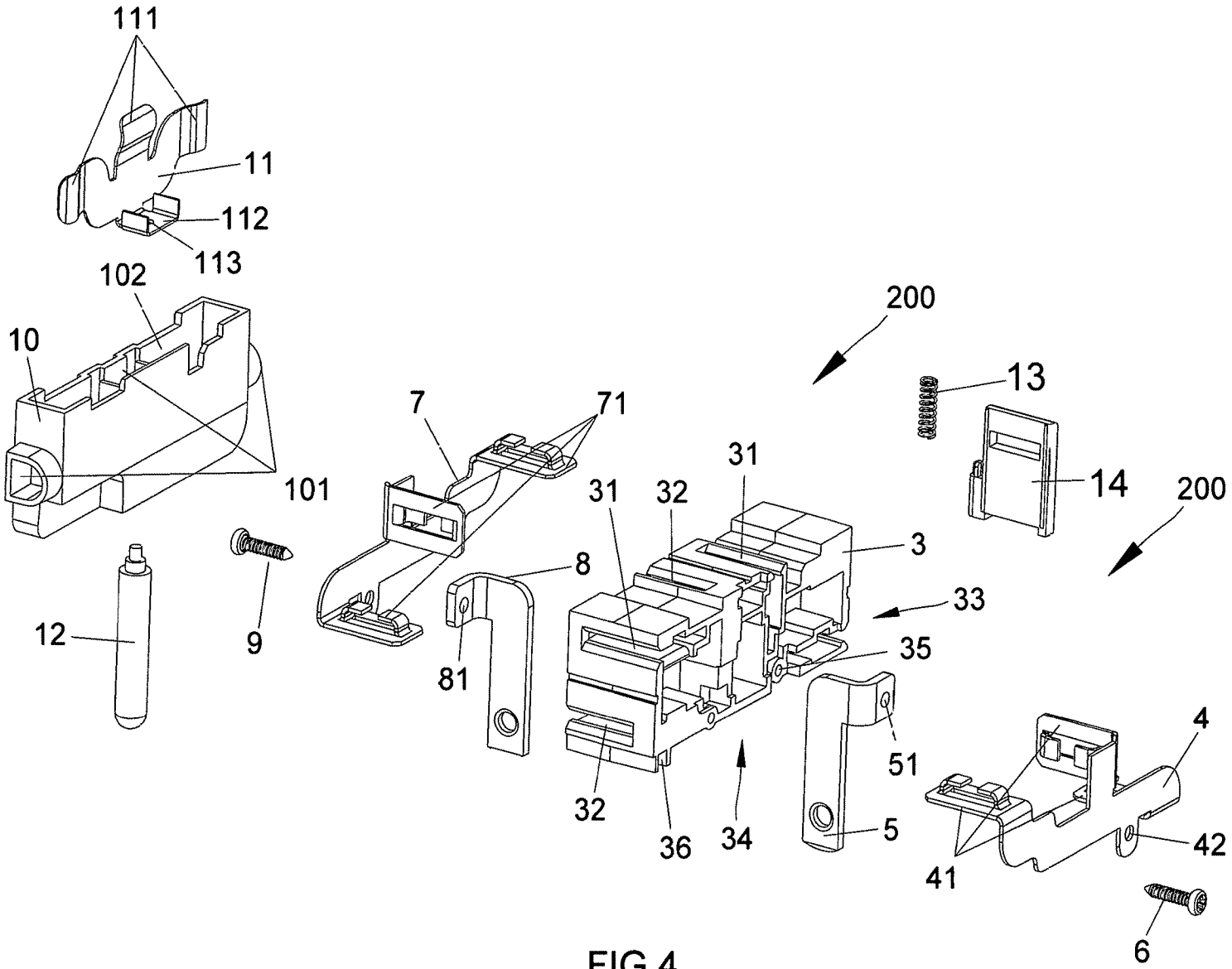
FIG. 4 is a schematic exploded view of a three-pole multi-position conversion device of the present utility model.
Figure 5:
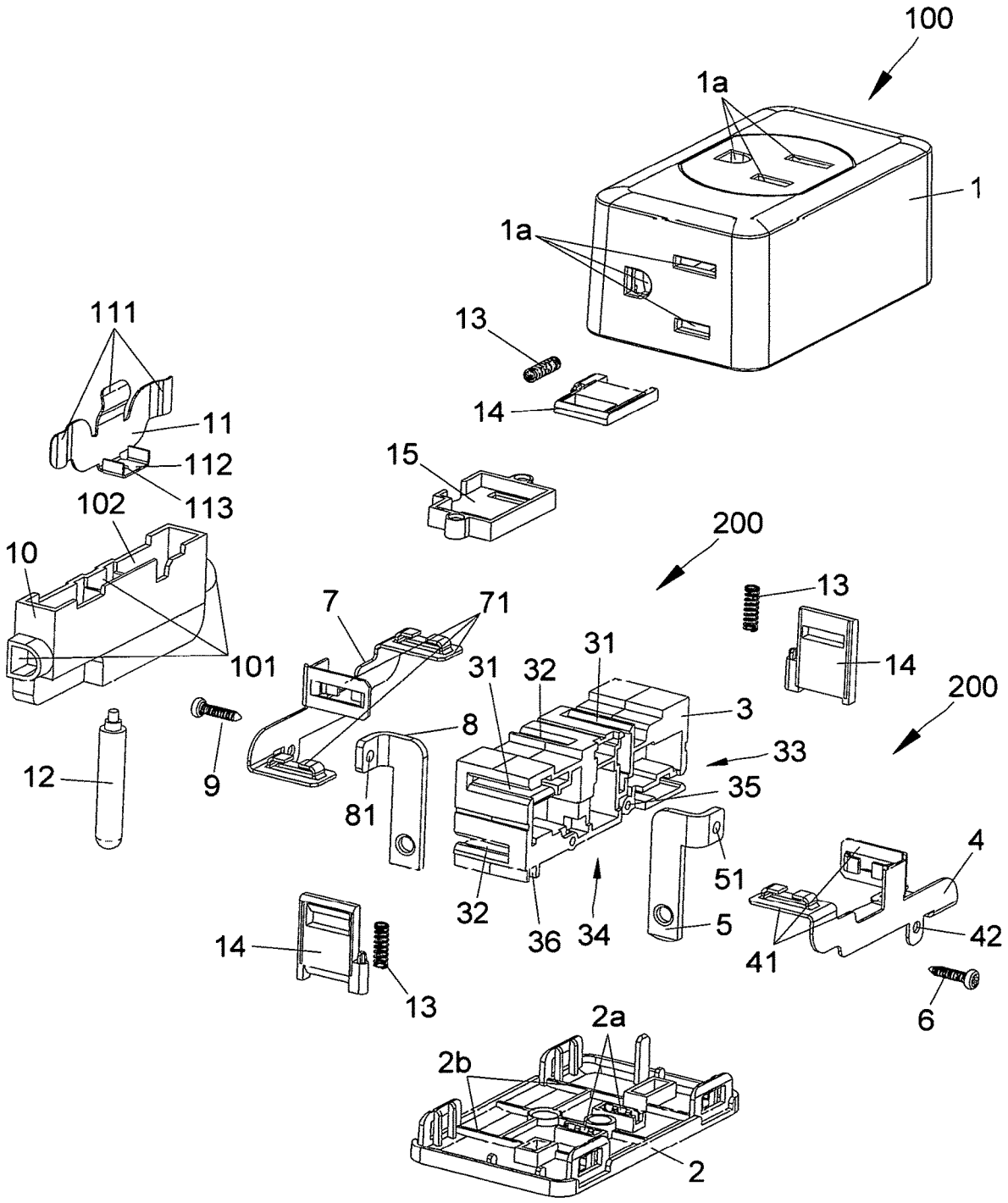
FIG. 5 is a schematic exploded view of one embodiment of a three-pole multi-position conversion socket of the present utility model.

In the embodiments of the present utility model, two, three, four or five of the top, left, right, front and rear sides of the main frame 3 can be designed with matching first inserting slots 31 and second inserting slots 32; in the preferred embodiments of the present utility model, as shown in FIG. 1 and FIG. 2, the top, left and right sides of the main frame 3 are designed with matching first inserting slots 31 and second inserting slots 32, and accordingly, the top, left and right sides of the housing 100 are designed with pin apertures 1*a* corresponding to the first inserting slots 31 and the second inserting slots 32.

Concretely, the main frame 3 is cuboid as a whole, a first pin clamping slot 34 and a first clamping slot 33 are designed on the front side of the main frame 3, the upper part of the first pin 5 is clipped into the first pin clamping slot 34 and the first clamping slot 33 is connected with the first inserting slots 31 on the top, left and right sides of the main frame, the first connecting sheet 4 is clipped into the first clamping slot 33 and has three first connecting parts 41 extending into the first inserting slots 31 on the top, left and right sides of the main frame respectively; a second pin clamping slot (not shown in the drawings) and a second clamping slot (not shown in the drawings) are designed on the rear side of the main frame 3, the upper part of the second pin 8 is clipped into the second pin clamping slot (not shown in the drawings), the second clamping slot is connected with the second inserting slots 32 on the top, left and right sides of the main frame, the second connecting sheet 7 is clipped into the second clamping slot and has three second parts 71 extending into the second inserting slots 32 on the top, left and right sides of the main frame 3 respectively.

Optionally, the first inserting slot 31 and the second inserting slot 32 on the left side of the main frame 3 are distributed vertically and separately, the first inserting slot 31 is located above the second inserting slot 32; the first inserting slot 31 and the second inserting slot 32 on the right side of the main frame 3 are distributed vertically and separately, the first inserting slot 31 is located under the second inserting slot 32; the first inserting slot 31 and second inserting slot 32 on the top side of the main frame 3 is distributed horizontally and separately, the first inserting slot 31 is located on the right side of the second inserting slot 32.

Further, the first clamping slot 33 is connected with the first pin clamping slot 34, the first connecting sheet 4 is of dismountable secure connection with the main frame 3 via the first screw 6 and tightly presses the first pin 5 into the first pin clamping slot 34, and in the same way, the second clamping slot (not shown in the drawings) is connected with the second pin clamping slot (not shown in the drawings), the second connecting sheet 7 is of dismountable secure connection with the main frame 3 via the second screw 9 and tightly presses the second pin 8 into the second pin clamping slot (not shown in the drawings), and the electrical connection of the first pin 5, the first connecting sheet 4, the second pin 8 and the second connecting sheet 7 are only by direct contact not via any conducting piece (not shown in the drawings). Concretely, the first connecting sheet 4 is designed with the first screw aperture 42, the main frame is designed with the first screw hole 35 at the position corresponding to the first screw aperture 42, the rod of the first screw 6 first passes through the first screw aperture 42 and then is of rotating connection with the first screw hole 35 so that the first connecting sheet 4 is of dismountable installation onto the main frame 3, the second connecting sheet 7 is designed with the second screw aperture 72, the main frame 3 is designed with the second screw hole (not shown in the drawings) at the position corresponding to the second screw aperture 72, the rod of the second screw 9 first passes through the second screw aperture 72 and then is of rotating connection with the second screw hole so that the second connecting sheet 7 is of dismountable installation onto the main frame 3.

Understandably, the above embodiment is an embodiment of the conversion device 200 of a two-pole conversion socket; during its use, one of the first connecting sheet 4 and the second connecting sheet 7 is used as the live-wire connecting sheet and the other one is used as the null-wire connecting sheet, depending on which one of the first pin 5 and the second pin 8 is connected with the live wire of the power socket.

Whereas the power sockets are divided into three-pole ones and two-pole ones, for the matching use with three-pole power sockets, the multi-position conversion device 200 of the present utility model also comprises a sub-frame 10 set in the housing 100, an earth-wire pin 12 and an earth-wire connecting sheet 11, the sub-frame 10 and the main frame 3 are adjacent front and back, the top, left and right sides of the sub-frame 10 are designed with a third inserting slot 101 pairing the first inserting slot 31 and the second inserting slot 32 respectively on the top, left and right sides of the main frame 3, the housing 100 is designed with pin apertures 1*a* at the positions corresponding to the third inserting slots 101 for the earth-wire pins of an electronic product to pass and be inserted into the third inserting slots 101, the earth-wire connecting sheet 11 has three earth-wire connecting parts 111 extending into the third inserting slots 101, the upper part of the earth-wire pin 12 is installed into the sub-frame 10 and of electrical connection with the earth-wire connecting sheet 11, the lower part extends out via the pin apertures 2*a* on the bottom side of the housing 100 so that it together with the first pin 5 and the second pin 8 is inserted into the three-pole power socket at the time of use, all the three third inserting slots 101 are located in front of (or behind) the corresponding first inserting slots 31 and second inserting slots 32 and arranged in an orderly and well-bedded manner.

In the embodiments of the present utility model, the sub-frame 10 is cuboid as a whole, its top side is designed with a third clamping slot 102 and its bottom side is designed with a third pin clamping slot (not shown in the drawings), the third clamping slot 102 is connected with three third inserting slots 101, the earth-wire connecting sheet 11 is inserted into the third clamping slot 102 (not shown in the drawings), the three earth-wire connecting parts 111 are inserted into the third inserting slots 101 respectively, the earth-wire pin 12 is clamped into the third clamping slot 102 and connected with the earth-wire connecting sheet 11. Concretely, the earth-wire connecting sheet 11 has an extending part 112 at the position corresponding to the earth-wire pin 12, the extending part 112 is designed with a riveting opening 113, the step axis-shaped upper part of the earth-wire pin 12 passes through the riveting opening 113 and is riveted with the extending part 112 of the earth-wire connecting sheet 11 to locate the earth-wire pin 12 and the earth-wire connecting sheet 11 for electrical connection.

Understandably, the main frame 3 and the sub-frame can be an integrated or split-type structure; the integrated structure is convenient for assembly with the housing 100; the split-type structure is convenient for two-pole or three-pole conversion socket fabrication as per functional requirements.

Further, the front, rear, left, right and bottom sides of the sub-frame 10 are encapsulated (not shown in the drawings) to ensure complete isolation of the earth-wire pin 12 and the earth-wire connecting sheet 11 with the live wire.

The present utility model also provides a conversion socket, as shown in FIG. 1 to FIG. 8, the conversion socket comprises a housing 100 and a multi-position conversion device 200 wherein the structure of the multi-position conversion device 200 is subject to the above embodiment. The conversion socket adopts all the technical solutions of all embodiments of the multi-position conversion device 200 described above. Therefore, it at least possesses all the beneficial effects arising from the technical solutions of the embodiments described above, and the beneficial effects are not repeated one by one here.

Concretely, the housing 100 comprises an upper cover 1 and a bottom housing 2 buckling each other wherein the upper cover 1 and the bottom housing 2 are of dismountable secure connection via a screw or buckling structure and form an accommodating space which can accommodate the multi-position conversion device 200, the pin apertures 2*a* are designed at the bottom housing 2, the top, left and right sides of the upper cover 1 are designed with pin apertures 1*a* used for inserting the plugs of electronic products. The main frame 3 or both the main frame 3 and the sub-frame 10 are tightly pressed and fixed between the upper cover 1 and the bottom housing 2. Concretely, the bottom side of the main frame 3 or the bottom sides of both the main frame 3 and the sub-frame 10 is or are designed with a first locating slot 36 respectively, the inner side of the bottom housing 2 is designed with first reinforcing positions 2*b* matching the first locating slot 36, the bottom housing 2 is located with the main frame 3 or both the main frame 3 and the sub-frame 10 through the coupling of the first reinforcing positions 2*b* and the first locating slot 36; the top side of the main frame 3 or the top sides of both the main frame 3 and the sub-frame 10 is or are designed with a second locating slot 37, the inner side of the upper cover 1 is designed with second reinforcing positions (not shown in the drawings) matching the second locating slot, the upper cover 1 is located with the main frame 3 or both the main frame 3 and the sub-frame 10 through the coupling of the second reinforcing positions and the second locating slot 37; after being fixed securely, the upper cover 1 and the bottom housing 2 can fix the main frame 3 or both the main frame 3 and the sub-frame 10 into the accommodating space.

Figure 6:
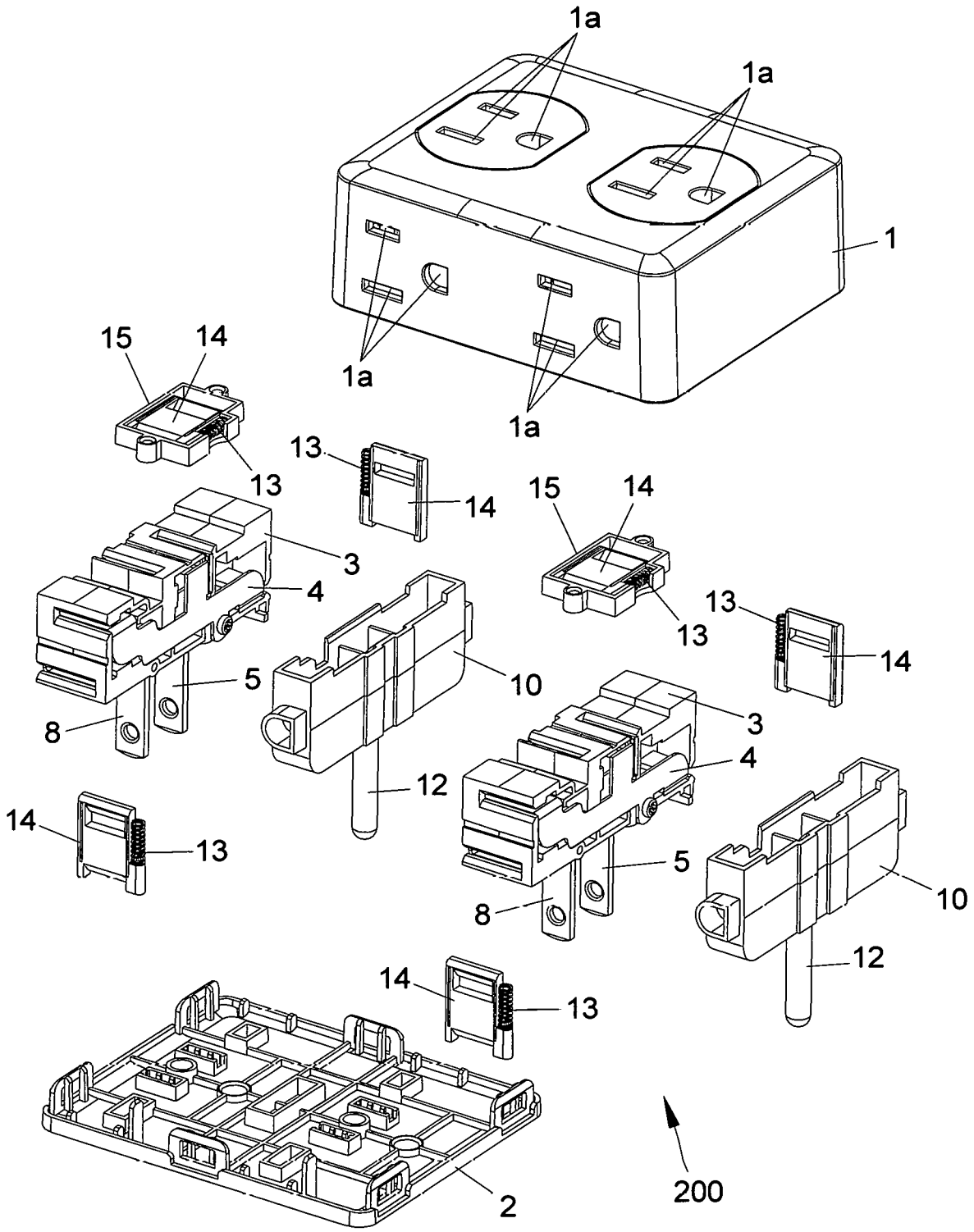
FIG. 6 is a schematic exploded view of another embodiment of a three-pole multi-position conversion socket of the present utility model.
Figure 7:
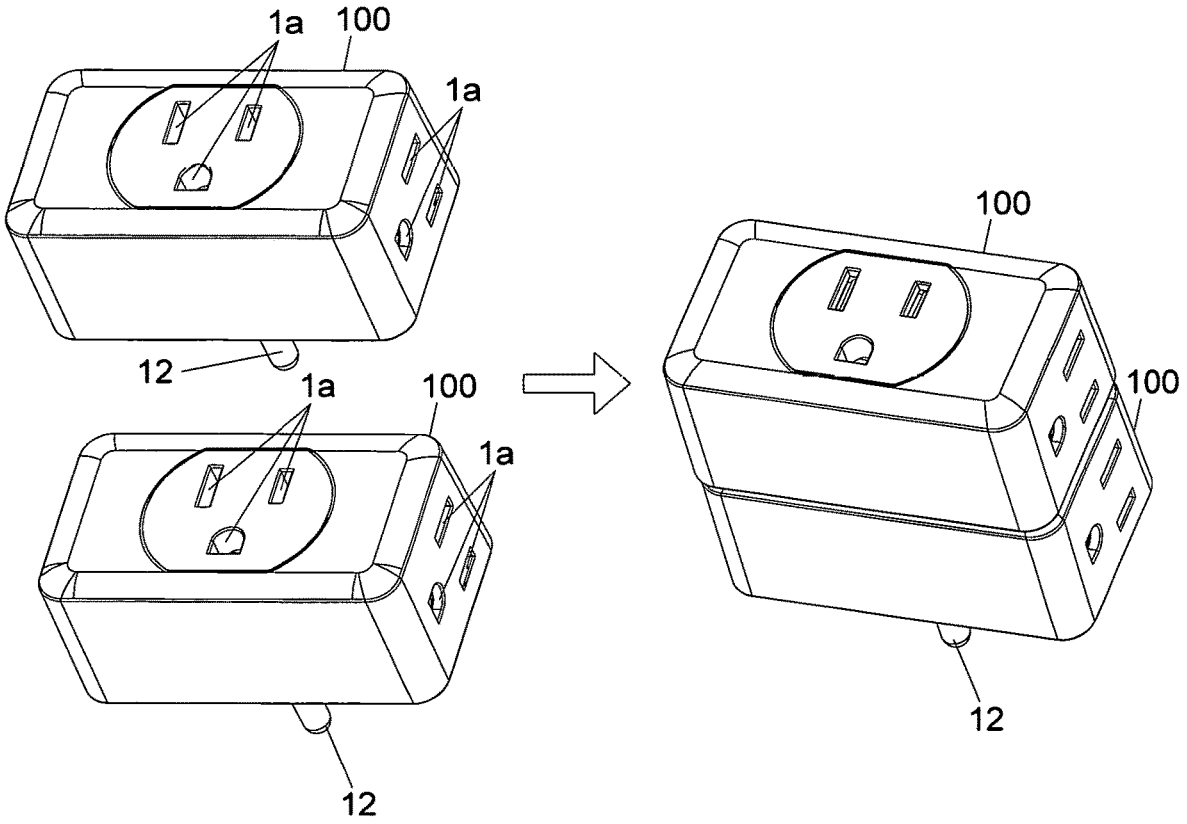
FIG. 7 is a schematic diagram used for one embodiment combination of three-pole multi-position conversion sockets.
Figure 8:
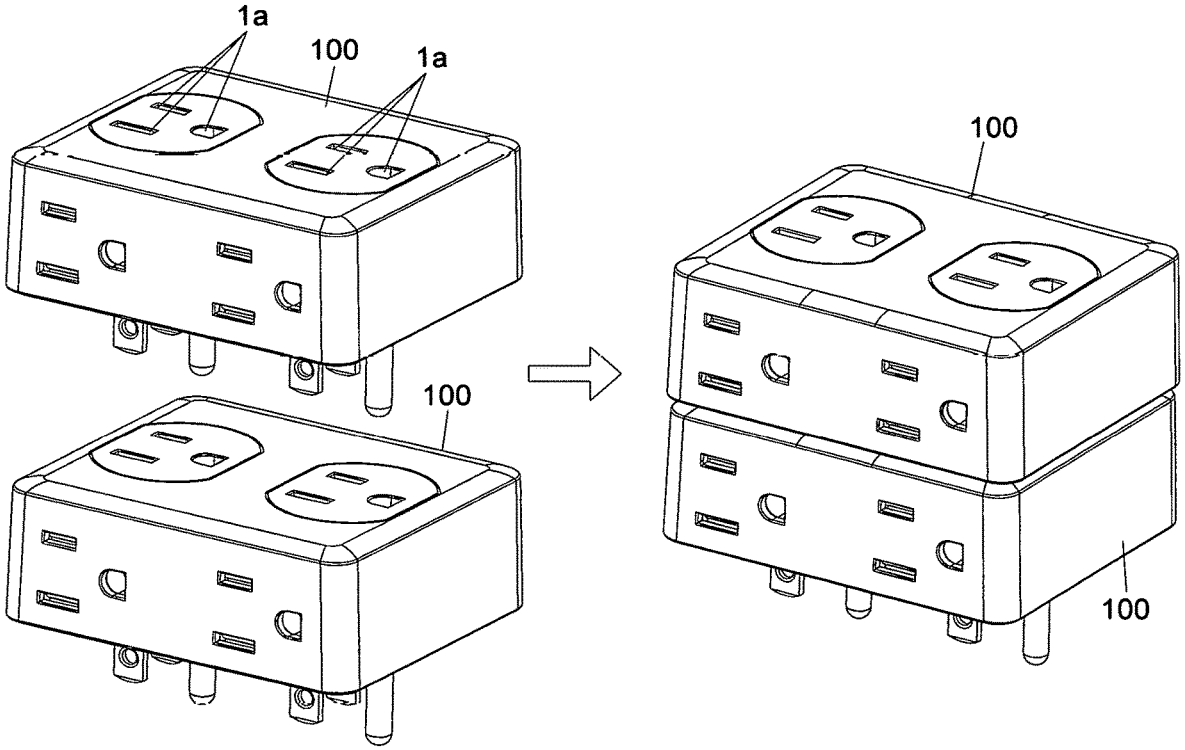
FIG. 8 is a schematic diagram used for another embodiment combination of three-pole multi-position conversion sockets.

Optionally, the housing 100 can be installed with one or multiple groups of multi-position conversion devices 200; when being installed with multiple groups of multi-position conversion devices 200, the multi-position conversion devices 200 are distributed side by side front and back, wherein FIG. 1 to FIG. 5 and FIG. 7 show the circumstance in which one group of multi-position conversion devices 200 are installed while FIG. 6 and FIG. 8 show the circumstance in which two groups of multi-position conversion devices 200 are installed.

It can be understood that the conversion socket of the present utility model can conform to American, Chinese, British or European specifications and the American conversion socket is preferred. When it is an American conversion socket, the length of the housing 100 fits the length of an American wall-type power socket to increase the adaptability of the conversion socket to the American wall-type power socket and the aesthetic feeling of use.

Preferably, as shown in FIG. 7 and FIG. 8, the pin apertures 1*a* on the top side of the housing 100 are of one-to-one correspondence to the pin apertures 2*a* on the bottom side of the housing 100; such setting way can realize mutual vertical insertion of multiple conversion sockets with identical poles; on the premise that the overall length and width are not increased and the multiple conversion sockets are combined for inserting the plugs of more electronic products.

Further, the housing 100 is also designed inside with a USB charging module of electrical connection with the first pin 5 and the second pin 8, the front and/or rear side of the housing 100 are or is designed with USB ports (not shown in the drawings) to install the charging ports (not shown in the drawings) of the USB charging module and thus increase the functionality of the conversion socket.

Further, the position corresponding to the pin apertures 1*a* on the inner side of the housing 100 is also installed with a safety door 14 and a reset spring 13, wherein the safety door 14 can move between the positions of closing and starting the pin apertures 1*a*, the reset spring 13 is used to put resilience on the safety door 14 for it to move towards the position of closing the pin apertures 1*a*; when a plug of an electronic product is inserted into the pin apertures 1*a*, the safety door 14 will overcome the resilience of the reset spring 13 and move to the position where the pin apertures 1*a* are started with the thrusting action of the pins of an electronic product plug (such as the first pin and the second pin, or the first pin, the second pin and the earth-wire pin); when the electronic product plug is pulled out, the safety door 14 will close the pin apertures 1*a* again with the resilience of the reset spring 13 to achieve the effects such as dust prevention and safety protection. There are multiple ways of installing safety door 14 and the reset spring 13; for example, one way is to set sliding slots in the housing (not shown in the drawings), install the safety door 14 in a sliding manner into the sliding slots and one end of the reset spring is propped against the safety door 14 and the other end is propped against the housing 100. Or, a hood-shaped guide plate 15 is set at the upper position inside the housing 100, the guide plate 15 and the inner side of the housing 100 form a guide space fitting the safety door 14 which is installed into the guide space in a sliding manner, one end of the reset spring 13 is propped against the safety door 14 and the other end is propped against the guide plate 15.

The embodiments described above are merely the preferred embodiments of the present utility model, not to limit the patent scope of the present utility model; with the conception of the present utility model, any equivalent structure transformation using the Specifications and the accompanying drawings of the present utility model or direct/indirect applications to other related technical fields should be included in the scope claimed by the present utility model.

What is claimed is:

1. A multi-position conversion device, configured to be installed in a housing of a conversion socket, comprises a main frame, a first pin, a second pin, a first connecting sheet and a second connecting sheet, wherein the upper parts of the first pin and the second pin are installed onto the main frame, at least two of the top, left, right, front and rear sides of the main frame are designed with a first inserting slot and a second inserting slot respectively, the first connecting sheet and the second connecting sheet are inserted into the main frame and are electrically connected with the first pin and the second pin respectively, the first connecting sheet has a first connecting part extending to the first inserting slot and the second connecting sheet has a second connecting part extending to the second inserting slot;

wherein the top, left and right sides of the main frame are designed with matching first and second inserting slots corresponding to pin apertures designed on the top, left and right sides of the housing;

wherein the main frame is cuboid as a whole, a first pin clamping slot and a first clamping slot are designed on the front side of the main frame, the upper part of the first pin is clipped into the first pin clamping slot and the first clamping slot is connected with the first inserting slots on the top, left and right sides of the main frame, the first connecting sheet is clipped into the first clamping slot and has three first connecting parts extending into the first inserting slots on the top, left and right sides of the main frame respectively; a second pin clamping slot and a second clamping slot are designed on the rear side of the main frame, the upper part of the second pin is clipped into the second pin clamping slot, the second clamping slot is connected with the second inserting slots on the top, left and right sides of the main frame, the second connecting sheet is clipped into the second clamping slot and has three second parts extending into the second inserting slots on the top, left and right sides of the main frame respectively.

2. The multi-position conversion device in accordance with claim 1, wherein the first inserting slot and the second inserting slot on the left side of the main frame are distributed vertically and separately, the first inserting slot is located above the second inserting slot; the first inserting slot and the second inserting slot on the right side of the main frame are distributed vertically and separately, the first inserting slot is located under the second inserting slot; the first inserting slot and second inserting slot on the top side of the main frame is distributed horizontally and separately, the first inserting slot is located on the right side of the second inserting slot.

3. The multi-position conversion device in accordance with claim 1, wherein the first clamping slot and the first pin clamping slot are connected, the first connecting sheet is of dismountable secure connection with the main frame via a first screw and tightly presses the first pin into the first pin clamping slot, the second clamping slot is connected with the second pin clamping slot, the second connecting sheet is of dismountable secure connection with the main frame via a second screw and tightly presses the second pin into the second pin clamping slot.

4. The multi-position conversion device in accordance with claim 3, wherein it also comprises a sub-frame in the housing, an earth-wire pin and an earth-wire connecting sheet, the sub-frame and the main frame are adjacent front and back, the top, left and right sides of the sub-frame are designed with a third inserting slot respectively pairing the first inserting slot and the second inserting slot on the top, left and right sides of the main frame, the housing is designed with pin apertures at the positions corresponding to the third inserting slots, the earth-wire connecting sheet has an earth-wire connecting part extending into the third inserting slots, the upper part of the earth-wire pin is installed into the sub-frame and electrically connected with the earth-wire connecting sheet, the lower part extends out via the pin apertures on the bottom side of the housing.

5. The multi-position conversion device in accordance with claim 4, wherein the sub-frame is cuboid as a whole, its top side is designed with a third clamping slot and its bottom side is designed with a third pin clamping slot, the third clamping slot is connected with three third inserting slots, the earth-wire connecting sheet is inserted into the third clamping slot, the three earth-wire connecting parts are inserted into the third inserting slots respectively, the earth-wire pin is clamped into the third clamping slot and connected with the earth-wire connecting sheet.

6. The multi-position conversion device in accordance with claim 5, wherein the earth-wire connecting sheet has an extending part at the position corresponding to the earth-wire pin, the extending part is designed with rivet, the step axis-shaped upper part of the earth-wire pin passes through the rivet and is riveted with the extending part of the earth-wire connecting sheet.

7. A conversion socket comprises a housing and the multi-position conversion device in accordance with claim 6.

8. The conversion socket in accordance with claim 7, wherein the housing comprises a upper cover and a bottom housing buckling each other, the upper cover and the bottom housing are of dismountable secure connection via a screw or buckling structure and form an accommodating space which can accommodate the multi-position conversion device, the bottom side of the main frame or the bottom sides of both the main frame and the sub-frame is or are designed with a first locating slot respectively, the inner side of the bottom housing is designed with first reinforcing positions matching the first locating slot; the top side of the main frame or the top sides of both the main frame and the sub-frame is or are designed with a second locating slot respectively, the inner side of the upper cover is designed with second reinforcing positions matching the second locating slot; after being fixed securely, the upper cover and the bottom housing can fix the main frame or both the main frame and the sub-frame into the accommodating space.

9. The conversion socket in accordance with claim 7, wherein the housing is installed with one or multiple groups of multi-position conversion devices inside, in case of multiple groups of multi-position conversion devices, the multi-position conversion devices are distributed side by side front and back.

10. The conversion socket in accordance with claim 7, wherein the pin apertures on the top and bottom sides of the housing are of one-to-one correspondence.

11. The conversion socket in accordance with claim 7, wherein the conversion socket is an American conversion socket, the length of the housing fits the length of American wall-type power socket.

12. The conversion socket in accordance with claim 7, wherein the housing is also designed inside with a USB charging module electrically connected with the first pin and the second pin, the front and/or rear side of the housing is designed with USB ports used to install the charging ports of the USB charging module.

13. The conversion socket in accordance with claim 6, wherein the position corresponding to the pin apertures on the inner side of the housing is installed with a safety door and a reset spring, the safety door can move between the positions of closing and starting the pin apertures, the reset spring is used to put resilience on the safety door for it to move towards the position of closing the pin apertures.

* * * * *